US009839798B2

(12) United States Patent
Franke et al.

(10) Patent No.: US 9,839,798 B2
(45) Date of Patent: Dec. 12, 2017

(54) SAFETY HOOD WITH A VISOR SIZE-INDEPENDENT FASTENING ON THE HEAD STRAP

(71) Applicant: Dräger Safety AG & Co. KGaA, Lübeck (DE)

(72) Inventors: Katja Franke, Lübeck (DE); Olaf Balke, Reinfeld (DE); Martin Rademacher, Grossheirath (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 218 days.

(21) Appl. No.: 14/753,184

(22) Filed: Jun. 29, 2015

(65) Prior Publication Data

US 2015/0375018 A1 Dec. 31, 2015

(30) Foreign Application Priority Data

Jun. 30, 2014 (DE) ..... 10 2014 009661

(51) Int. Cl.
*A62B 17/04* (2006.01)
*A41D 13/11* (2006.01)
*A62B 18/08* (2006.01)

(52) U.S. Cl.
CPC ..... *A62B 17/04* (2013.01); *A41D 13/1153* (2013.01); *A41D 13/1161* (2013.01); *A41D 13/1184* (2013.01); *A62B 18/082* (2013.01)

(58) Field of Classification Search
CPC .... A61F 9/025; A61F 9/02; A61F 9/06; A61F 9/08
USPC ..... 2/9, 202, 452, 205, 206, 420, DIG. 11, 2/416; 128/201.24, 201.29; 351/155, 351/156
See application file for complete search history.

(56) References Cited

U.S. PATENT DOCUMENTS 2,169,745 A * 8/1939 Shipman ..... A61F 9/02 2/8.2
2,758,307 A * 8/1956 Treiber ..... A61F 9/025 2/8.1
2,760,197 A * 8/1956 Jones ..... A61F 9/06 2/8.1
6,367,085 B1 4/2002 Berg

FOREIGN PATENT DOCUMENTS

FR 10 60 227 A 3/1954
WO 98/23172 A1 6/1998
WO 02/76555 A1 10/2002
WO 2009/070403 A1 6/2009

* cited by examiner

*Primary Examiner* — Gloria Hale
(74) *Attorney, Agent, or Firm* — McGlew and Tuttle, P.C.

(57) ABSTRACT

A safety hood (1), with a head strap (7) for fixation on the head (6) of a user of the hood, has features for adjusting the head strap (7) to different head sizes and/or head shapes. The respirator hood (1) has, further, a visor pane (4) and a flexible hood outer skin (8), which are connected with one another and of which the visor pane (4) is indirectly or directly fastened to the head strap (7). The visor pane (4) is fastened indirectly or directly to the head strap (7) exclusively in the area (10) of the forehead of the user of the hood.

20 Claims, 2 Drawing Sheets

SAFETY HOOD WITH A VISOR SIZE-INDEPENDENT FASTENING ON THE HEAD STRAP

CROSS REFERENCE TO RELATED APPLICATIONS

This application claims the benefit of priority under 35 U.S.C. §119 of German Patent Application DE 10 2014 009661.0 filed Jun. 30, 2014, the entire contents of which are incorporated herein by reference.

FIELD OF THE INVENTION

The present invention pertains to a safety hood (also known as protective hood or respirator hood) with a head strap for fixation on the head of a user of a hood, wherein the head strap can be adjusted to different head sizes and/or head shapes. The safety hood has, further, a visor pane and a flexible hood outer skin, which are connected with one another and of which the visor pane is fastened indirectly or directly to the head strap.

BACKGROUND OF THE INVENTION

The safety hoods described are preferably used together with blower filter systems. Such blower filter systems are designed for light and medium breathing protection and support the user during the use of use of breathing filters by reducing the breathing resistance, contrary to conventional breathing masks, and thus make possible a long, fatigue-free use.

Such a blower filter system usually has a blower filter device being carried on the belt and a breathing port, which is designed as a hood, helmet or mask. The individual components are connected with one another, as a rule, by means of a flexible tube. The polluted or contaminated air is drawn in by means of a blower and is made available to the user via a filter. At least the face, partially the entire head, neck and the shoulders are protected from contamination in case of the use of hoods as a breathing port. Hoods for blower filter devices are manufactured, as a rule, from a flexible material and have a port, which is often arranged in the nuchal area of the user and via which the purified air flows into the interior space of the hood.

The hood is transparent in the field of vision of the user in order for the user to be able to optically perceive the area surrounding him. The visor pane of the respirator hood is located in this field of vision of the user.

A respirator hood, which can be combined with a blower filter device, is described in WO 2009/070403 A1. The hood has essentially a head strap for fixing the hood on the head of the user, a flexible outer skin, which surrounds the head and partially the face of the user, as well as a visor pane, which is arranged in the field of vision of the user and is connected with the flexible outer skin. Further, a porous material, which assumes the function of an exhalation valve, is provided in some areas beneath the visor pane in the chin area of the respirator hood, so that the air exhaled by the user, which is enriched with $CO_2$, is released into the surrounding area. The air flows within the hood from a circular air inlet, which is connected with an externally connected flexible tube, at first into the area of the nape or the back of the head of the user and subsequently into the facial space over the head.

To fix the visor pane on the head strap, the carrying ring of the strap has two fastening elements. These two fastening elements are arranged in the area of the lateral edges of the visor pane, so that a free space is created between the carrying ring of the strap and the visor pane, which shall guarantee good flow of the air, in the area of the user's forehead.

A respirator hood of this class is described, further, in U.S. Pat. No. 6,367,085 B1. The visor pane is connected with the strap in this case as well, and a total of four fastening points are provided, two of which are located in the area of the user's forehead and two in the area of the outer edges of the visor pane. Since the visor pane is fastened to the head strap in this technical solution in the outer area, on the one hand, but, moreover, also in the area of the user's forehead, this type of fastening represents a comparatively rigid connection between the head strap and the visor pane.

It is common to the prior-art respirator hoods that the fastening of the visor pane on the strap always takes place in the area of the outer edges of the visor panes, and the visor pane is often connected in this area with the carrying ring of the strap. The visor pane is bent due to this kind of fastening, so that a free space, which shall guarantee good flow of the air, develops between the user's face and the visor pane. However, the adjustment of the head strap, especially of the carrying ring, varies depending on the size of the head as well as the shape of the head of the user, so that the free space between the head strap and the visor pane may also be different or different curvatures of the visor pane will develop depending on the size and shape of the user's head.

It is therefore often problematic in the prior-art fastenings for visor panes in respirator hoods that the properties of the air flow change as a function of the free space that becomes established between the head strap and the visor pane and the air flow that becomes established in the area of the face is partially felt as being unpleasant, especially when a comparatively strong air flow is flowing over the eyes. The eyes may dry out and become irritated because of such forms of flow, especially when using a respirator hood over a rather long time. Furthermore, the field of vision may decrease and unwanted reflection phenomena may occur because of the radius of curvature that becomes established because of the different radii of curvature. Moreover, great curvature of the visor pane may lead to comparatively great stresses within the visor pane, which may comparatively easily lead to slipping of the respirator hood during use. This represents a considerable limitation in respect to work safety as well as wearing comfort.

SUMMARY OF THE INVENTION

Based on the respirator hoods known from the state of the art as well as the above-described problems, a basic object of the present invention is to further perfect a respirator hood or safety hood such that the size of the head as well as the shape of the head of a user hardly affect the free space between the forehead and the visor pane and the visor pane thus always has the same curvature regardless of the user of the hood. The development of unwanted stresses within the visor pane shall be reliably prevented here. Furthermore, it shall be ensured by a suitable fastening of the visor pane on the head strap that unacceptable flow phenomena will not occur in the free space between the forehead and the visor pane, and especially that the eyes will be reliably prevented from being compromised. The technical solution to be proposed shall be able to be manufactured in a comparatively simple manner both in terms of design and from an economic point of view and shall not have an adverse effect on the user of the hood in terms of wearing comfort.

The object explained above is accomplished with a respirator hood or safety hood according to the invention. A safety hood with a head strap for fixation on the head of a user of the hood, which has means for adjusting the head strap to different head sizes and/or head shapes, as well as with a visor pane and with a flexible hood outer skin (hood element), which are connected with one another and of which the visor pane is indirectly or directly fastened to the head strap, is further perfected according to the present invention such that the visor pane is fastened indirectly or directly to the head strap exclusively in the forehead area of the user of the hood. A connection is thus provided according to the present invention between the visor pane and the head strap, which connection has a carrying ring made of plastic material surrounding the head, in the forehead area of the user, while there is no fastening on the head strap at the outer edges of the visor pane. An essential feature of this technical solution is that regardless of the size of the head as well as the shape of the head and hence regardless of the adjustment of the head strap, the fastening point or fastening points always act at the same point of the head strap.

The visor pane is thus always located in the same relative positioning in relation to the fastening point on the head strap. As a result, it is always ensured that the curvature of the visor pane is always the same regardless of the adjustment of the head strap. It is even conceivable, in principle, to combine visor panes of different sizes with a head strap, because the fastening always takes place exclusively in the forehead area of the user. Since the visor pane is connected with the head strap in the forehead area only, it can be adjusted to the different head shapes without the shape of the visor pane being changed. The air flow, which flows along the visor pane, thus remains the same for all head shapes and head sizes. The fastening elements between the visor pane and the head strap are preferably positioned such that they are located above the eyes, and are shaped such that a possible air flow flowing past close to the eye is deflected, so that the eyes are preferably on the side of the least one fastening element that is sheltered from the flow.

According to a special embodiment of the present invention, at least one holding element is provided at the head strap for fastening the visor pane, and this holding element maintains the visor pane at a spaced location from the head strap in the forehead area of the user of the hood. The free space between the visor pane and the forehead of the user can thus be set as a function of the size and the length of this holding element. It is ensured, in turn, based on the fastening of the visor pane on the head strap in the forehead area of the user that the free space is always the same regardless of the size of the head or the shape of the head of the user of the hood.

It is, further, conceivable that a strap, which is connected with the visor pane and which is indirectly or directly fastened to the head strap, is provided in the upper area of the visor pane. This strap preferably has a groove, in which the upper area of the visor pane is arranged in at least some sections. It is conceivable in this connection that the upper edge of the visor pane is completely or partially inserted into the groove and is fixed there. According to a special variant, at least one locking and/or clamping element, which is in functional connection with the visor pane, is provided within the groove. If such a locking and/or clamping element is provided, the visor pane is simply inserted into the groove during the manufacture of a respirator hood designed according to the present invention, and a preferred fixation takes place quasi automatically by means of the locking or clamping element.

In a special embodiment, the strap provided in the upper area of the visor pane has at least one reinforcement each at its outer ends. The reinforcement is designed here such that it is ensured that the strap will also not undergo an unwanted deformation in the outer area.

Moreover, the fastening of the visor pane on the head strap is advantageously designed such that the eyes of the user of the hood are sheltered at least partially from an air flow flowing into the facial space from above the forehead area between the outer skin of the hood and the head of the user of the hood. At least one air guide element, by which an air flow flowing into the facial space from above the forehead area is deflected at least partially, is preferably provided here in the forehead area of the user of the hood. The air flow is preferably deflected such that the flow does not flow past the eyes, i.e., the eyes are quasi on the side of the at least one air guide element that is sheltered from the flow. It is conceivable according to an especially preferred embodiment of the present invention that the at least one air guide element is integrated in the at least one fastening or connection element between the visor pane and the head strap. It appears especially suitable in this connection that two connection elements are provided in the area of the user's forehead between the head strap, especially the carrying ring of the head strap, and the visor pane, wherein the two fastening or connection elements are arranged above the user's eyes. The at least one air guide element is advantageously shaped such that the air flow flowing from above into the facial space is kept away from the eyes or is guided around the eyes. The air guide element, which may be part of the fastening or connection elements, is preferably designed in a triangular shape or in the form of a triangular prism or has an arched design, and one vertex of the triangle or edge of the triangular prism or the arch is directed opposite the direction of the air flow. The air flow flowing from above into the facial space is quasi split in this manner by the at least one air guide element and is deflected around the user's eyes.

In a very special variant of the present invention, the visor pane is connected with the flexible outer skin of the hood by means of a sewn seam in at least some sections. The visor pane is preferably connected by the sewn seam with the flexible outer skin of the skin over its entire circumference. As an alternative or in addition, it is conceivable that the flexible material of the outer skin of the hood is bonded to the visor pane in at least some sections or is connected with the visor pane by welding. Further, the flexible outer skin of the hood can be preferably fastened to the head strap at at least one point by means of a snap fastener or a hook and loop fastener. The provision of a connection between the flexible outer skin of the hood and the head strap, which can be manufactured and likewise detached in a correspondingly simple manner, offers, on the one hand, advantages in terms of manufacturing technology.

The present invention will be explained in more detail below without limitation of the general inventive idea on the basis of exemplary embodiments with reference to the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
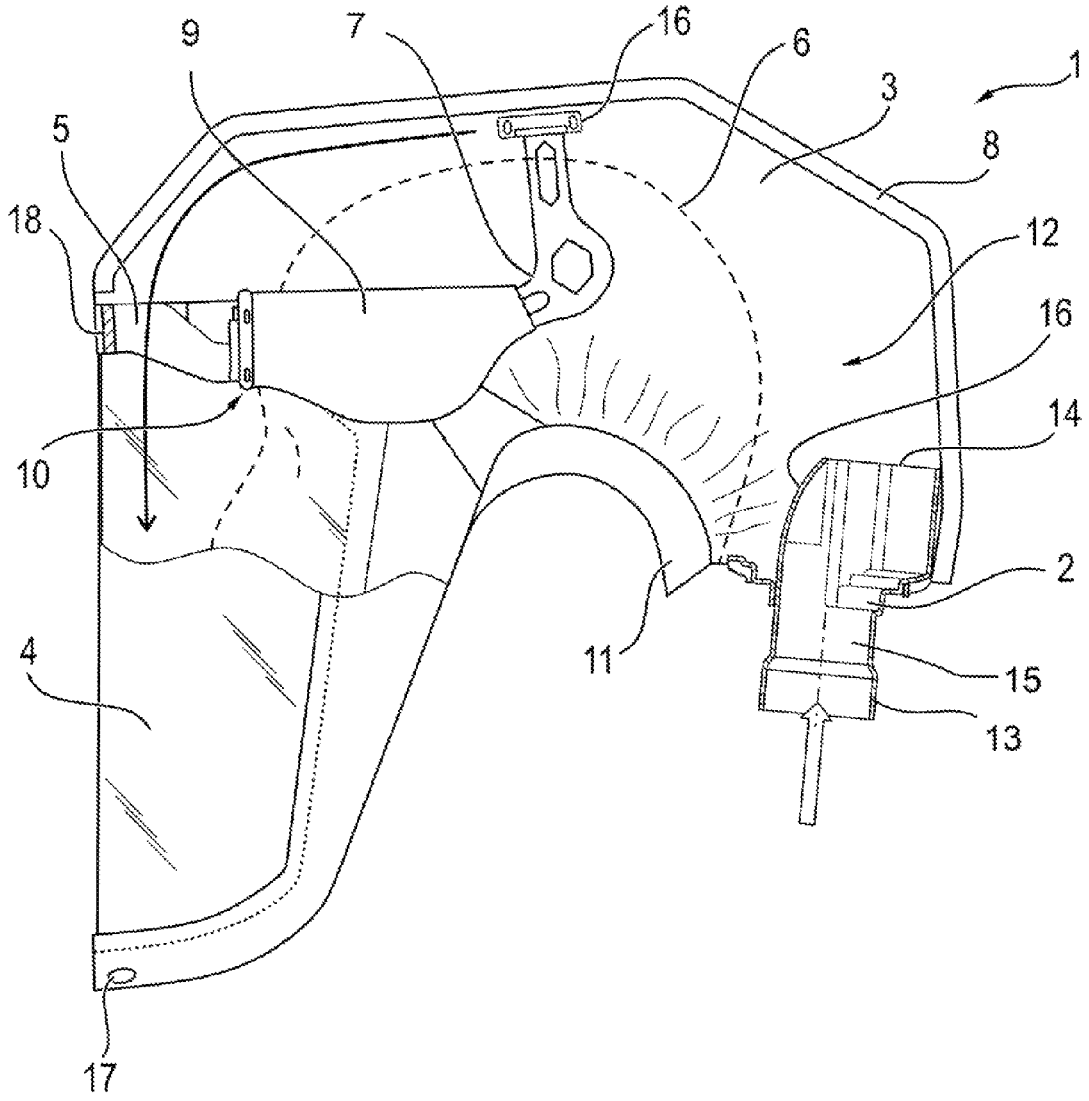
FIG. 1 is a side view of a respirator hood.

Referring to the drawings, FIG. 1 shows a side view of a respirator hood 1, which has a fastening of the visor pane 4 on a head strap 7, which said fastening is designed according to the present invention. The head 6 of a user is indicated by broken line in the interior space 3 of the hood. The outer skin 8 of the hood 1 surrounds the head 6 sealingly, such that the user is protected from polluted or contaminated ambient air, on the one hand, and purified air can be sent via the air inlet into the interior 3 of the hood, on the other hand.

The visor pane 4, which is fastened to the head strap 7 of the respirator hood 1 carried on the head 6 exclusively in the forehead area 10, is provided in the field of vision of the user. The head strap 7 has a carrying ring made of plastic material 9, which surrounds the head 6 of the user and via which the forces acting on the respirator hood 1 are transmitted to the head 6. The strap 7 is connected with the visor pane 4 by means of suitable fastening elements 5.

To guarantee removal of the exhaled air, which has a high $CO_2$ concentration, from the interior space 3 of the hood, porous material, preferably a textile material, which assumes the function of an exhalation valve 17, is provided under the chin area in some sections. The air exhaled by the user can escape through this porous material, but no unpurified ambient air can enter the interior space 3 of the hood.

The outer skin 8 of the respirator hood 1 has a flexible hood material, which is fastened, on the one hand, on the visor pane 4 such that it extends circumferentially around it, and is connected, on the other hand, with a rubber-like face seal 11, which surrounds the user in the area of the chin, neck and nape and is in contact there. Further, the strap 7 has suitable adjusting elements 16, by means of which a vertical adjustment of the strap 7 with the carrying ring made of plastic material 9 is made possible in order to adjust the strap 7 to the size of the head and the shape of the head of the user.

An air guide component 2 passes through the flexible material of the hood in the occipital area 12 of the gas mask 1. An external flexible tube, which is in turn connected in a fluid-tight manner with a blower filter unit carried by the user on a belt or with another source of compressed air (not shown), is connected to the air guide component 2 during the use of the respirator hood. Purified air is sent by the blower filter unit into the interior space 3 of the hood via the flexible tube and the air inlet 14. The air subsequently flows from the occipital area 12 into the area of the user's face over the head 6, and the air flow flows downwardly from above over the forehead area.

Two fastening elements 5 in the form of struts, which connect the strap 7 with the visor pane 4, are provided in the area 10 of the user's forehead. A connection between the strap 7 with the carrying ring 9 thereof and the visor pane 4 is provided exclusively in the area 10 of the user's forehead. It is ensured in this manner, on the one hand, that the curvature of the visor pane 4 and hence the free space 20 between the strap 7 and the visor pane 4 remain unchanged even in case of different adjustments of the strap 7.

A visor pane strap (visor support element) 18 has a groove 21, into which the upper edge of the visor pane is inserted, is provided in the upper area of the visor pane 4. The visor pane 4 is fixed within this groove 21 by means of detents, which are pressed in some sections against the surface of the visor pane 4 in the mounted state. The two fastening elements 5, which establish a connection between the head strap 7 and the visor pane 4, are fastened to the carrying ring 9 of the strap 7, on the one hand, and to the visor pane strap 18, which receives the visor pane 4 in a groove 21, on the other hand. According to the exemplary embodiment being explained here, the visor pane 4 is consequently connected indirectly with the fastening element 5, which establishes the connection with the strap 7.

The two fastening elements 5 are arranged each above the user's eyes and have an air guide element 19, which is made in one piece with the respective fastening element 5. The air guide element 19 has a triangular or arrow-like cross section, with the tip being directed against the direction of flow of the air flow. The air flow reaching the air guide elements 19 of the fastening elements 5 from the area 10 of the forehead is split by the air guide elements 19, so that the user's eyes are not reached directly by the flow, but they are mostly on the side of the fastening elements 5 that is sheltered from the flow. Drying out of the eyes as well as eye irritations are reliably avoided or at least greatly reduced in this manner.

Figure 2:
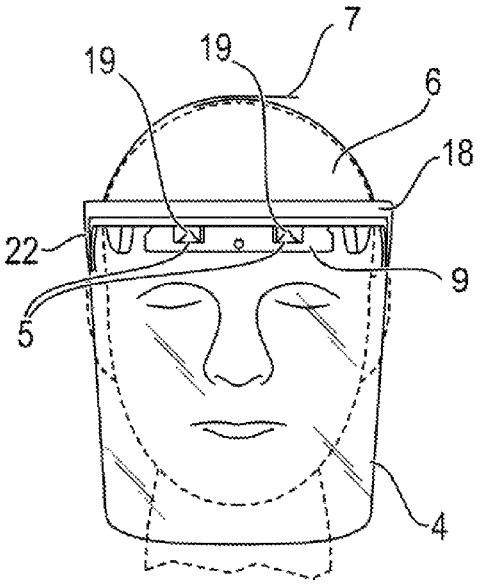
FIG. 2 is a front view showing the fastening of a visor pane on the carrying ring of a head strap.
Figure 3:
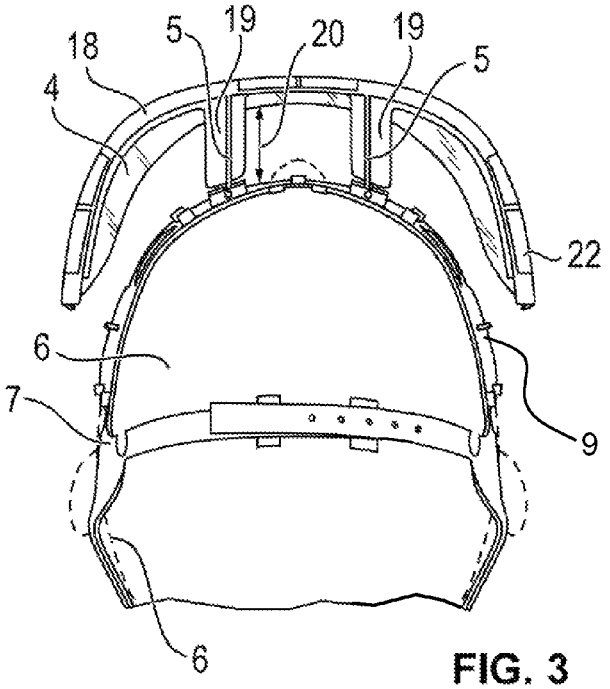
FIG. 3 is a top view showing the fastening of a visor pane on the carrying ring of a head strap.

FIGS. 2 and 3 show a front view and a top view of a head 6 with a head strap 7 fixed thereon, to which a visor pane 4 is fastened in the area 10 of the user's forehead. To achieve greater clarity, the flexible outer skin 8 is not shown in this figure. The flexible outer skin 8 of a respirator hood 1, as is shown as an example in FIG. 1, surrounds the head 6 as well as the neck of the user and is fastened on the circumference to the visor pane 4 by means of a sewn seam.

The visor pane strap 18, which has the groove 21, into which the upper edge area of the visor pane 4 is inserted and is fixed there, is provided at the upper edge of the visor pane 4. The strap 18 has an arc-shaped design and its shape follows the shape of the head of a user, and a distance is provided as a free space 20 between the head 6 of the user and the strap 18. Two fastening elements 5, which are fastened to the head strap 7, on the one hand, and to the visor pane strap 18, on the other hand, are provided between the carrying ring 9 of the head strap 7 and the strap 7. These fastening elements 5 are arranged exclusively in the area 10 of the user's forehead, so that the free space 20 between the forehead and the strap 18 or the visor pane 4 fastened thereto can be kept unchanged even in case of different users and consequently different head sizes and head shapes. The strap 18 is not fastened in the lateral outer area.

The fastening elements 5 are arranged above the eyes of a user, so that an air flow entering the area of the face from above is split by the fastening elements 5 and the eyes are quasi on the side of the fastening elements 5 that is sheltered from the flow. Exposure of the user's eyes to the flow, which often leads to drying of the eyes as well as eye irritations, is avoided in this manner at least to a great extent.

Figure 4:
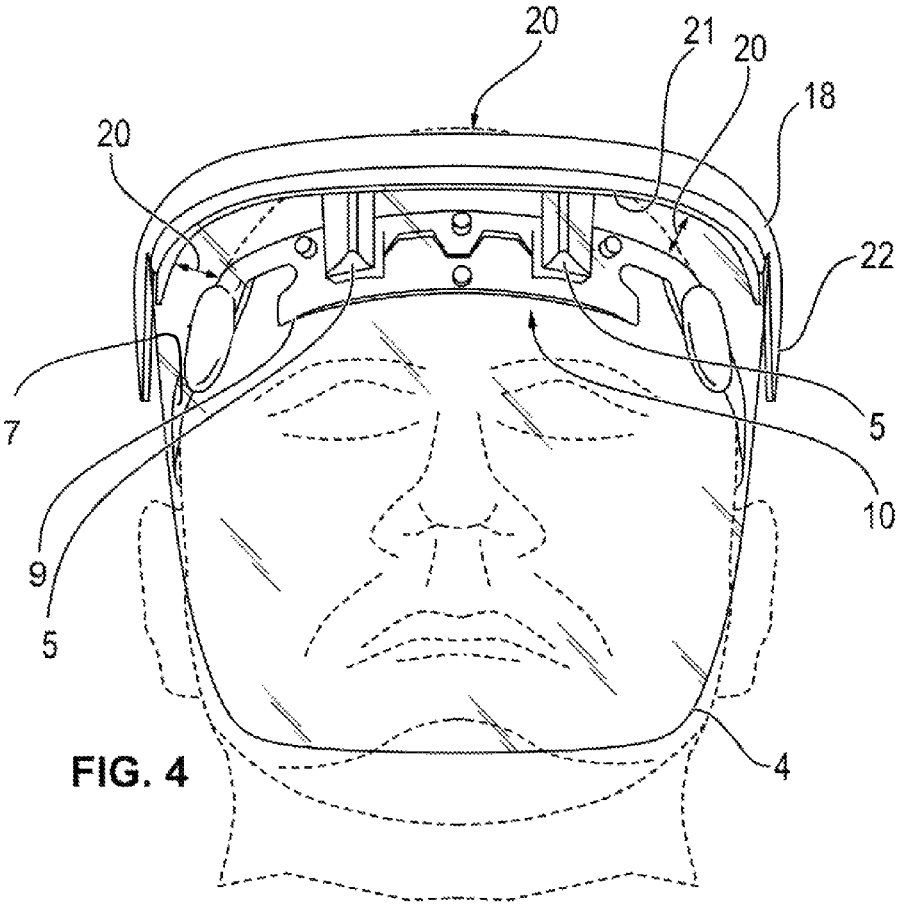
FIG. 4 is a bottom front perspective view showing the carrying ring of a head strap with a strap fastened thereto for receiving a visor pane.

In addition to FIGS. 2 and 3, FIG. 4 shows an oblique view from the bottom of a carrying ring 9 of a head strap 7, to which ring the visor pane strap 18 is fastened for receiving the visor pane 4. The flexible outer skin 8 and the visor pane 4 are likewise not shown in this view.

Two fastening elements 5 are in turn provided between the carrying ring 9/head strap 7 and the strap 18, and these fastening elements 5 are located exclusively in the area 10 of the user's forehead, namely, above the eyes. The visor strap or visor support 18 has a groove 21, into which the visor pane 4 can be inserted. Locking elements are located within this groove 21, so that the visor pane 4 is fixed in its position when inserted into the groove 21 of the strap 18. At its two opposite lateral ends, the strap 18 has two essentially triangular guide elements 22. These elements 22 fulfill essentially two tasks. On the one hand, they are designed such that the visor pane 4 is guided during insertion on at least one side during the mounting of the visor pane 4, so that the insertion of the visor pane 4 into the groove 21 of the strap 18 is simplified. On the other hand, the two guide elements 22 provided at the ends of the strap 18 ensure that the visor pane 4 will have a defined lateral contour. This is especially significant because the strap 18, which holds the visor pane 4, is connected with the carrying ring 9 of the head strap 7 exclusively in the area 10 of the user's forehead and is thus fixed exclusively in this area. Changes in the contour of the visor pane 4 in the lateral areas are reliably prevented from occurring due to the additional guide elements 22.

The strap or support 18 and hence the visor pane 4 arranged therein are again fastened to the carrying ring 9 of the head strap 7 exclusively in the areas 10 of the user's forehead. Fastening of the visor pane 4 independently from the size of the head as well as the shape of the head is ensured by this type of fastening. The free space 20 between the visor pane 4 and the user's face thus always remains the same even in case of different adjustments of the head strap 7. The flow conditions in the area of the user's face are thus also always almost identical and independent from the particular adjustment of the head strap 7.

It can, in turn, be clearly recognized that the two fastening elements 5 are arranged above the user's eyes. The user's eyes are thus on the side of the two fastening elements 5 that is sheltered from the flow, so that an air flow, which flows into the facial area from above the area 10 of the forehead, is directly largely around the eyes of the user. To achieve a corresponding deflection of the air flow, the fastening elements 5 have suitably designed air guide elements 19. Drying out as well as irritation of the eyes are thus reliably prevented even in case of prolonged use of a respirator hood 1.

While specific embodiments of the invention have been shown and described in detail to illustrate the application of the principles of the invention, it will be understood that the invention may be embodied otherwise without departing from such principles.

APPENDIX

List of Reference Numbers

1 Respirator hood
2 Air guide component
3 Interior space of hood
4 Visor pane
5 Fastening element
6 Head
7 Strap
8 Outer skin of hood
9 Carrying ring
10 Forehead area
11 Face seal
12 Occipital area
13 Connection piece
14 Air inlet
15 Air duct
16 Adjusting element
17 Exhalation valve
18 Strap
19 Air guide element
20 Free space
Groove
Guide element

What is claimed is:

1. A safety hood comprising:

a head strap for fixation on the head of a user of the hood, the head strap comprising an adjusting means for adjusting the head strap to different head sizes and/or head shapes;

a visor pane; and a flexible hood outer skin, the visor pane being connected with the flexible hood outer skin, wherein the visor pane is fastened indirectly or directly to the head strap exclusively in an area of the forehead of the hood user, wherein an upper area of the visor pane has a visor pane strap connected with the visor pane and indirectly or directly fastened to the head strap, the visor pane strap having a groove, in which the upper area of the visor pane is arranged at least partially.

2. A safety hood in accordance with claim 1, further comprising at least one fastening element provided on the head strap for the indirect or direct fastening of the visor pane, said fastening element holding the visor pane at a spaced location from the head strap in an area of the forehead of the hood user.

3. A safety hood in accordance with claim 1, wherein at least one locking and/or clamping element, which is in functional connection with the visor pane, is provided within the groove.

4. A safety hood in accordance with claim 1, wherein the visor pane strap has at least one guide element at each of outer ends thereof.

5. A safety hood in accordance with claim 1, wherein the visor pane is fastened on the head strap to define an at least partial shelter, of eyes of the user of the hood, from an air flow flowing into a facial space from above the forehead area between the outer skin of the hood and the head of the user of the hood.

6. A safety hood in accordance with claim 1, further comprising at least one fastening strut, which maintains the visor pane at a spaced location from the head strap, provided in the area of the forehead of the user of the hood between the head strap and the visor pane.

7. A safety comprising:

a head strap for fixation on the head of a user of the hood, the head strap comprising an adjusting means for adjusting the head strap to different head sizes and/or head shapes;

a visor pane;

a flexible hood outer skin, the visor pane being connected with the flexible hood outer skin, wherein the visor pane is fastened indirectly or directly to the head strap exclusively in an area of the forehead of the hood user;

at least one fastening element provided on the head strap for the indirect or direct fastening of the visor pane, said fastening element holding the visor pane at a spaced location from the head strap in an area of the forehead of the hood user; and at least one air guide element, by which an air flow flowing into a facial area from above the area of the forehead is deflected at least partially, is provided in an area of the fastening element on the head strap on the visor pane.

8. A safety hood in accordance claim 1, wherein the visor pane is connected with the flexible outer skin of the hood by means of a sewn seam, weld seam and/or bonded seam in at least some sections.

9. A safety hood in accordance with claim 1, further comprising a snap fastener or a loop and hook fastener, wherein the flexible outer skin of the hood is detachably fastened to the head strap by means of the snap fastener or the loop and hook fastener, at least at one point.

10. A protective hood comprising:

a head strap for engaging a head of a user of the hood, the head strap being adjustable to different head sizes and/or head shapes, the head strap having a forehead portion in a region of a forehead of the hood user;

a visor pane;

a flexible hood element, the visor pane being connected with the flexible hood element; and a fastening device fixing the visor pane indirectly or directly only to the forehead portion of the head strap, whereby the visor pane is connected to the head strap exclusively in the region of the forehead of the hood user, the head strap further comprising a carrying ring at the head strap forehead portion and the fastening device being provided between the visor pane and the head strap at the carrying ring, in the forehead region of the user, with no fastening features on the head strap at outer edges of the visor pane, wherein the fastening device provides one or more fastening locations always acting at the carrying ring.

11. A protective hood in accordance with claim 10, wherein an upper area of the visor pane has a visor pane support element connected with the visor pane and indirectly or directly fastened to the head strap.

12. A protective hood in accordance with claim 11, wherein the visor pane support element comprises:

a groove, in which the upper area of the visor pane is arranged at least partially;

at least one locking and/or clamping element, which is in functional connection with the visor pane, is provided within the groove; and the visor pane support element has at least one guide element at each of outer ends thereof.

13. A protective hood in accordance with claim 10, wherein the visor pane is fastened on the head strap to define an at least partial shelter, of eyes of the user of the hood, from an air flow flowing into a facial space from above the forehead area between the flexible hood element of the hood and the head of the user of the hood.

14. A protective hood in accordance with claim 10, wherein the fastening device further comprises at least one fastening strut, which maintains the visor pane at a spaced location from the head strap, provided in the area of the forehead of the user of the hood between the head strap and the visor pane.

15. A protective hood in accordance with claim 10, further comprising at least one air guide element, by which an air flow flowing into a facial area from above the area of the forehead is deflected at least partially, is provided in an area of the fastening element on the head strap on the visor pane.

16. A protective hood in accordance claim 10, wherein the visor pane is connected with the flexible hood element via at least one of a sewn seam, weld seam and a bonded seam in at least some sections.

17. A protective hood in accordance with claim 10, further comprising a snap fastener or a loop and hook fastener, wherein the flexible hood element is detachably fastened to the head strap by means of the snap fastener or the loop and hook fastener, at least at one point.

18. A safety hood comprising:

a head strap for fixation on the head of a user of the hood, the head strap comprising an adjusting means for adjusting the head strap to different head sizes and/or head shapes;

a visor pane; and a flexible hood outer skin, the visor pane being connected with the flexible hood outer skin, wherein the visor pane is fastened indirectly or directly to the head strap only in an area defined exclusively by the forehead of the hood user.

19. A safety hood in accordance with claim 18, wherein an upper area of the visor pane has a visor pane strap connected with the visor pane and indirectly or directly fastened to the head strap, the visor pane strap having a groove, in which the upper area of the visor pane is arranged at least partially.

20. A safety hood in accordance with claim 18, wherein a curvature of the visor pane is maintained during adjustment of the head strap via the adjusting means.

* * * * *